US006002214A

United States Patent [19]

Ribarich

[11] Patent Number: 6,002,214

[45] **Date of Patent: *Dec. 14, 1999**

[54] PHASE DETECTION CONTROL CIRCUIT FOR AN ELECTRONIC BALLAST

[75] Inventor: Thomas J. Ribarich, Laguna Beach, Calif.

[73] Assignee: International Rectifier Corporation, El Segundo, Calif.

[ * ] Notice: This patent is subject to a terminal disclaimer.

[21] Appl. No.: 09/022,555

[22] Filed: Feb. 12, 1998

Related U.S. Application Data

[60] Provisional application No. 60/037,923, Feb. 12, 1997.

[51] Int. Cl.[6] ..... G05F 1/00

[52] U.S. Cl. ..... 315/307; 315/244; 315/224; 315/194; 315/291; 315/DIG. 4

[58] Field of Search ..... 315/291, 307, 315/244, 224, 209 R, 194, DIG. 4, DIG. 7; 361/18, 58

[56] References Cited

U.S. PATENT DOCUMENTS

| | | | |
|---|---|---|---|
| 5,331,253 | 7/1994 | Counts | 315/209 R |
| 5,424,611 | 6/1995 | Moriarty, Jr. | 315/94 |
| 5,471,119 | 11/1995 | Ranganath et al. | 315/307 |
| 5,491,387 | 2/1996 | Saito | 315/307 |
| 5,525,872 | 6/1996 | Achten et al. | 315/291 |
| 5,539,281 | 7/1996 | Shackle et al. | 315/224 |
| 5,545,955 | 8/1996 | Wood | 315/224 |
| 5,717,295 | 2/1998 | Nerone | 315/307 |
| 5,719,472 | 2/1998 | Kachmarik et al. | 315/224 |
| 5,729,096 | 3/1998 | Liu et al. | 315/225 |
| 5,818,669 | 10/1998 | Mader | 361/18 |

FOREIGN PATENT DOCUMENTS

| | | |
|---|---|---|
| 62-249398 | 10/1987 | Japan . |
| 242396 | 3/1990 | Japan . |
| 2199797 | 8/1990 | Japan . |
| 2148595 | 12/1990 | Japan . |
| 349187 | 3/1991 | Japan . |
| 3156892 | 7/1991 | Japan . |
| 3169265 | 7/1991 | Japan . |
| 473893 | 3/1992 | Japan . |

*Primary Examiner*—David H. Vu
*Assistant Examiner*—Haissa Philogene
*Attorney, Agent, or Firm*—Ostrolenk, Faber, Gerb & Soffen, LLP

[57] ABSTRACT

A circuit for controlling the operating power of a fluorescent lamp by detecting the phase of the lamp resonant circuit current and regulating the phase of the current, thereby regulating the lamp power. In the preferred embodiment of the circuit, the phase of the resonant circuit current is detected using a sense resistor disposed between the low side power transistor of a half-bridge driver and ground, or between the lower voltage lamp filament and ground. The zero-crossings of the resonant circuit current is detected by comparing the voltage across the sense resistor to zero voltage. Using these zero crossings, a phase pulse is generated representing the lamp resonant circuit current as a function of time. This phase pulse is compared to a reference pulse to generate an error signal indicative of the phase difference between the phase pulse and the reference pulse. The frequency of the oscillating half-bridge driver is controlled in accordance with the error signal, such that the lamp power, and hence the brightness, is increased or decreased as necessary to keep the phase of the lamp resonant circuit locked to the phase of the reference pulse.

13 Claims, 6 Drawing Sheets

PHASE DETECTION CONTROL CIRCUIT FOR AN ELECTRONIC BALLAST

This application claims the benefit of U.S. Provisional Application Ser. No. 60/037,923, filed on Feb. 12, 1997.

BACKGROUND OF THE INVENTION

1. Field of the Invention

The present invention relates to a circuit for controlling an electronic ballast and, more specifically, to a phase detection circuit for controlling an electronic ballast.

2. Description of the Related Art

Controlling the brightness (Φ) given off by a fluorescent lamp being powered by an electronic ballast requires a circuit whose type can be classified as either "open-loop" or "closed loop". In an "open-loop" design, the controlling circuit knows nothing about what is occurring at the output. The operating point(s) are predetermined and fixed, regardless of changing conditions on the lamp or the ambient temperature. When a high quantity of ballasts which incorporate open-loop control are produced, trimming is required to account for component tolerances. Because the component tolerances alone can be large, the control circuit itself must have high accuracy which increases the cost for a good design. Furthermore, the circuit is still subject to lifetime effects of the lamp and changing ambient temperature.

In contrast, in a "closed-loop" design, information from the output is fed back to the control circuit allowing the circuit to automatically adjust itself for component tolerances, lamp life effects and temperature. Closed-loop control also allows for the lamp to be dimmed with extreme accuracy, which is especially important when a ceiling is filled with lamps, all of which should have the same brightness, particularly at low light levels, where differences from lamp to lamp are more readily detectable with the human eye. Closed-loop circuits also require less accurate designs, therefore reducing costs.

Referring to FIG. 1, one of the most common solutions to controlling the brightness of a fluorescent lamp using a closed-loop approach is to sense the lamp current with the use of a transformer 2. This allows for the lower cathode 4 of the lamp to be heated with the same current as the upper cathode 6, and allows for the lamp current to be separated from the heating current so it can be measured independently.

The lamp current can then be sensed with either a resistor or a second transformer 8. The secondary output of the transformer 8 is then rectified and low-pass filtered before compensated and summed with a reference voltage (REF). The resulting error (ERROR) then tells the control circuit to either increase or decrease the lamp current (usually by changing the frequency of a squarewave (VIN) driving a series/parallel RCL lamp resonant circuit consisting of inductor 12, capacitor 14 and the lamp) depending on whether the feedback signal (VFB) is higher or lower than the desired reference (REF).

The above-described classic control loop, however, has an inherent error due to the non-linear operation of rectification and has a high component count (2 transformers, rectifying diodes, compensation network, error amplifier, etc.).

Other solutions exist as well, but all require the use of a transformer of some sort to sense the actual lamp current.

SUMMARY OF THE INVENTION

The present invention of phase detection control uses a closed-loop approach and requires very few components, and no transformer, for sensing and processing the feedback information.

The circuit of the present invention controls the operating power of a fluorescent lamp, and hence the brightness of the lamp, by regulating the phase of the lamp resonant circuit current. In a preferred embodiment of the invention, the phase of the lamp resonant circuit current is detected using a sense resistor disposed between the low side power transistor of a half-bridge driver and ground, or between the lower voltage lamp filament and ground.

The zero-crossings of the current flowing through the lamp resonant circuit are detected by comparing the voltage across the sense resistor to zero voltage. Using these zero crossings, a phase pulse is generated representing the lamp resonant circuit current as a function of time. This phase pulse is compared to a reference pulse to generate an error signal indicative of the phase difference between the phase pulse and the reference pulse. The frequency of the oscillating half-bridge driver is controlled in accordance with the error signal, such that the lamp brightness is increased or decreased as necessary to keep the phase of the lamp resonant circuit locked to the phase of the reference pulse.

Other features and advantages of the present invention will become apparent from the following description of the invention which refers to the accompanying drawings.

DETAILED DESCRIPTION OF THE PREFERRED EMBODIMENT

Figure 2:
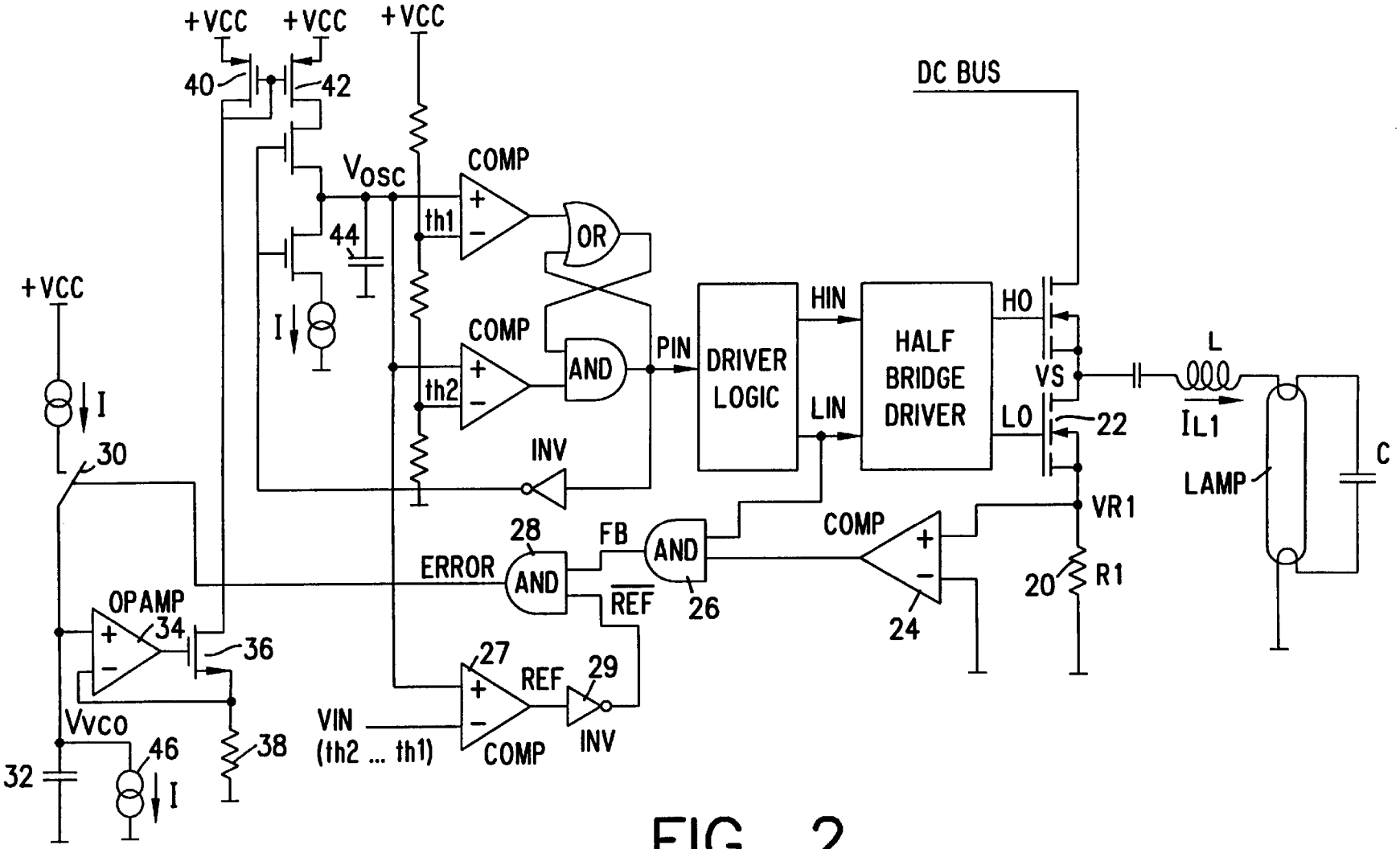
FIG. 2 shows the phase detection control circuit of the present invention.
Figure 3:
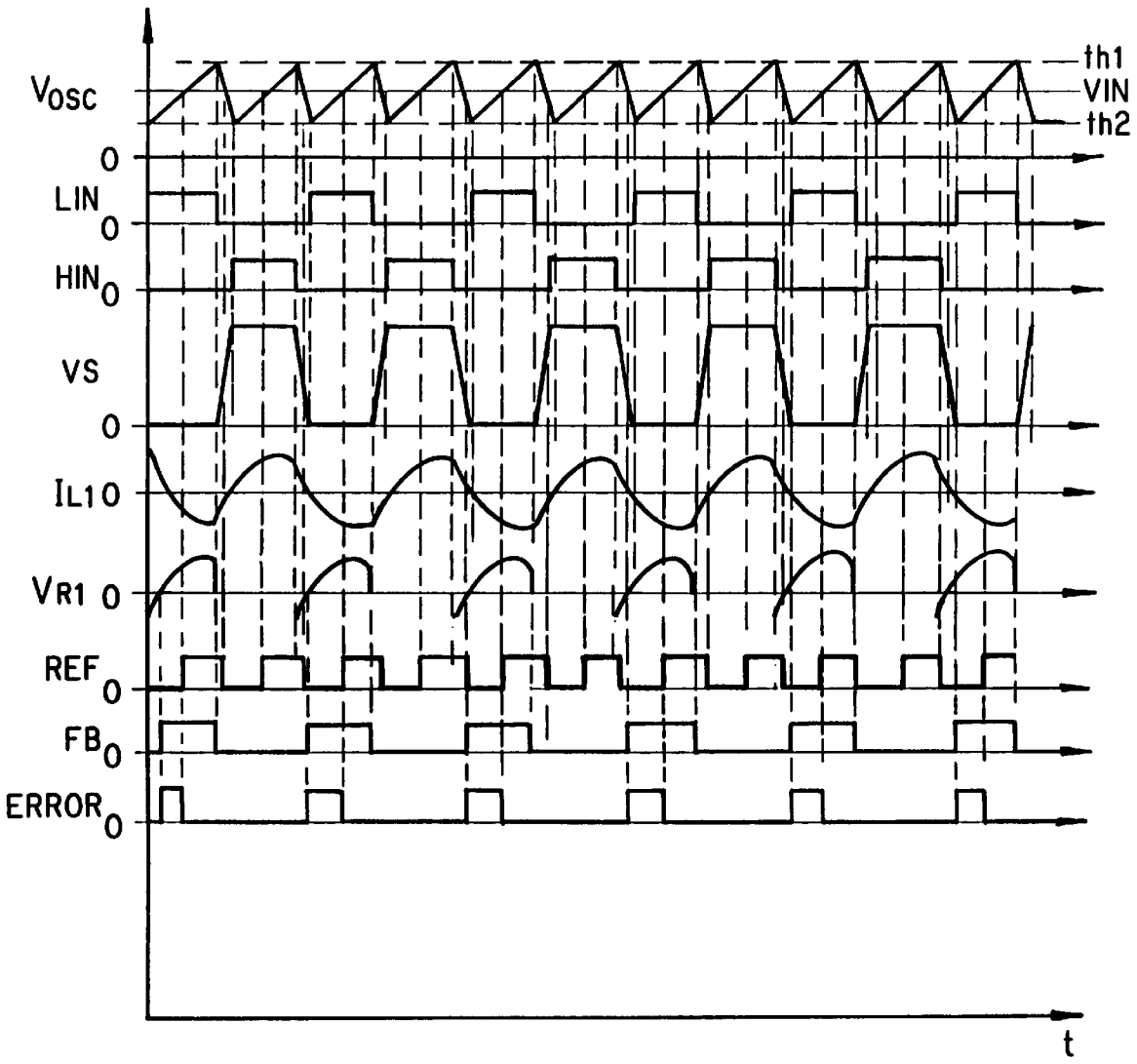
FIG. 3 is a timing diagram for the phase detection control circuit of the present invention.

The phase detection function performed by the present invention uses information from the phase (ϕ) of the lamp resonant circuit current, instead of the lamp current, to control the brightness (Φ) of the lamp. Referring to FIG. 2, the task of detecting the phase involves the simple but novel insertion of a sense resistor (R1), identified by reference number 20, in the source of the lower MOSFET or IGBT 22 of the half-bridge configuration driving the lamp resonant circuit. The resulting waveforms of the half-bridge and output resonant circuit with a lamp inserted and running (FIG. 3) show the current flow with respect to the output of the half-bridge (VS).

Figure 4:
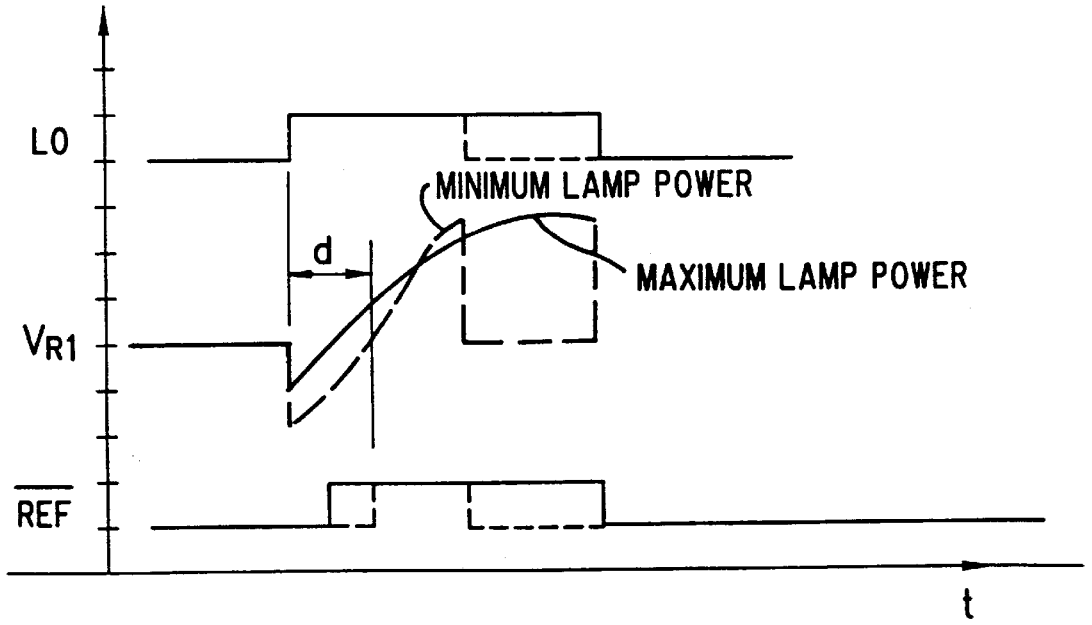
FIG. 4 shows the maximum and minimum lamp power control waveforms synchronized at the turn-on of the low-side power transistor.

FIG. 4 shows a detailed plot of the sense voltage (VR1) over one period of the switching frequency of the half-bridge voltage (VS).

Figure 5:
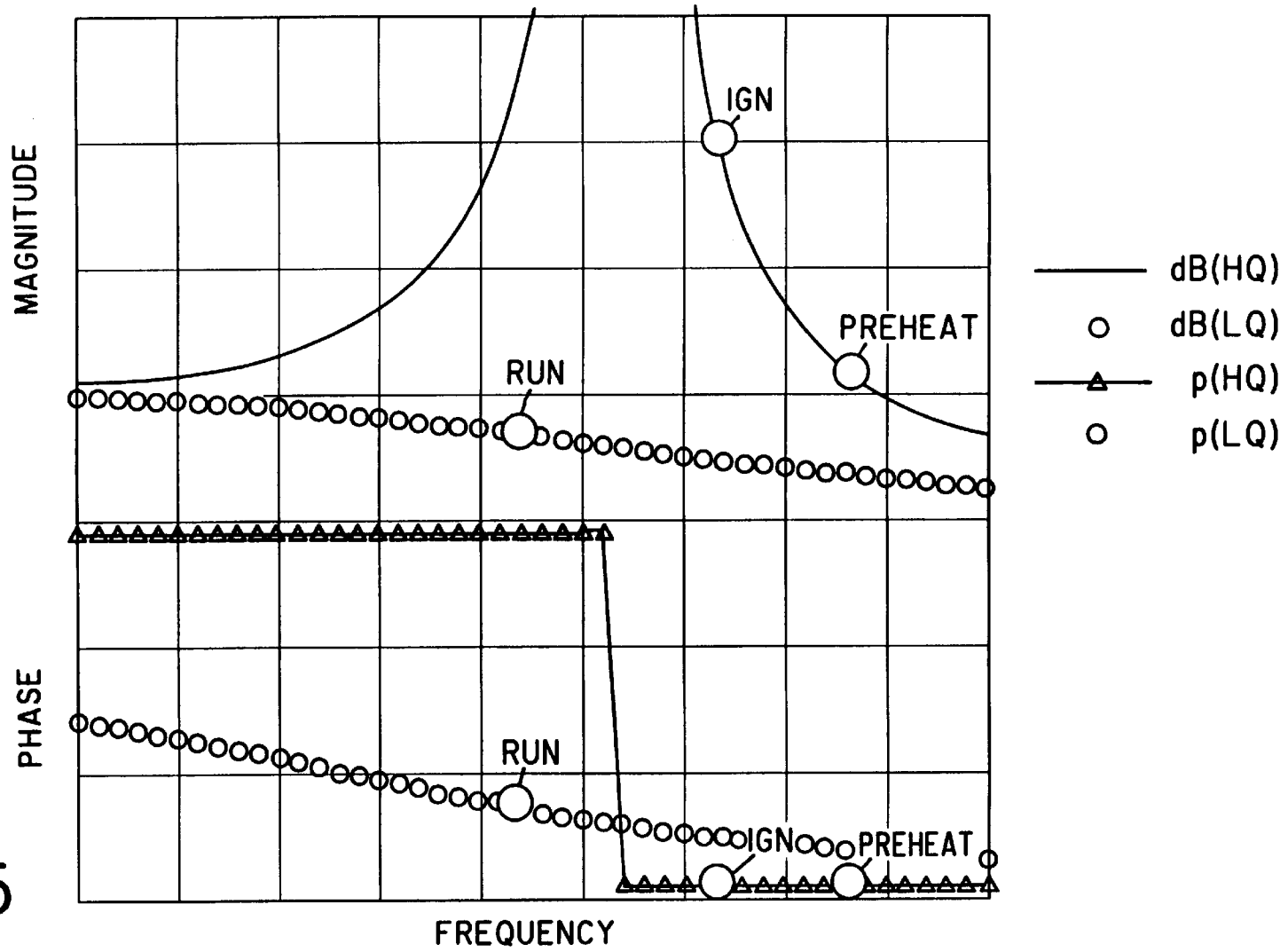
FIG. 5 is a Bode diagram showing the transfer function of $I_{L1}$/VS for different operating conditions.

FIG. 5 shows the Bode diagram for the transfer function of $I_{L1}$/VS for different operating conditions. During preheat and pre-ignition, the circuit is a high-Q series LC with a strong phase inversion from +90 to −90 degrees at the resonance frequency. The phase is therefore fixed at −90 degrees for the duration of preheat and pre-ignition. During running, the circuit is an L in series with a parallel R and C, with a weak inversion at high lamp power and a strong phase inversion at low lamp power.

In the time domain, the total output stage (lamp+filament) current is shifted −90 degrees from the input half-bridge voltage during preheat and pre-ignition, and somewhere between 0 and −90 degrees after ignition during running. Zero phase-shift corresponds to maximum output power. Solving for the phase angle of the inductor current to input voltage transfer function yields:

$$\varphi = \frac{360}{2\pi}\tan^{-1}\left[\left(\frac{V_{Run}^2}{P_{Run}}C - \frac{P_{Run}}{V_{Run}^2}L\right)2\pi f_{Run} - 8\frac{V_{Run}^2}{P_{Run}}LC^2\pi^3 f_{Run}^3\right] \text{ [degrees]}$$

where,

L=Output stage inductor [Henries]

C=Output stage capacitor [Farads]

$P_{Run}$=Lamp running power [W]

$V_{Run}$=Lamp running voltage amplitude [Volts]

$f_{Run}$=Running frequency corresponding to running power [Hz]

Figure 6:
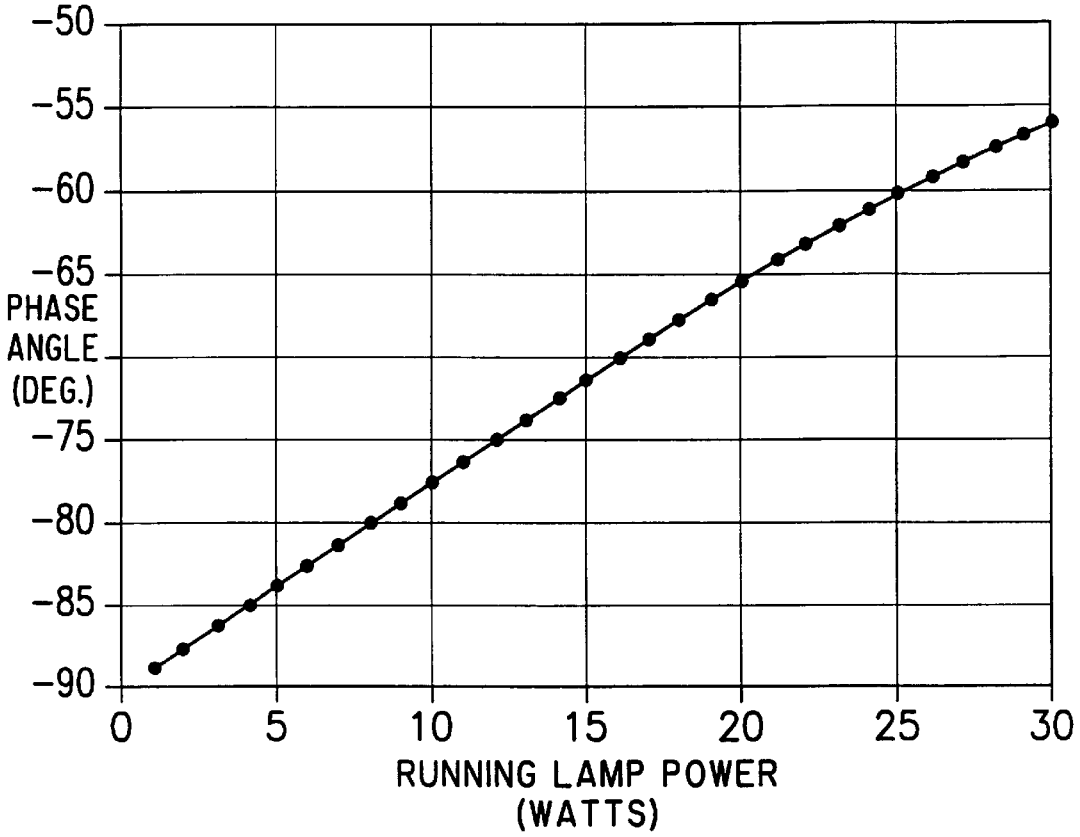
FIG. 6 shows a plot of lamp running power vs. the phase angle of the resonant circuit current.

When phase angle is plotted against lamp power, the result is a reasonably linear dimming curve, as shown in FIG. 6. A relationship therefore exists between the phase angle of the inductor current ($I_{L1}$) and running lamp power for closed-loop dimming control, and the change in phase when the lamp ignites allows for ignition to be detected and the loop to be closed.

The present invention uses a phase-locked loop to track the phase of the inductor current against an input reference phase.

Figure 1:
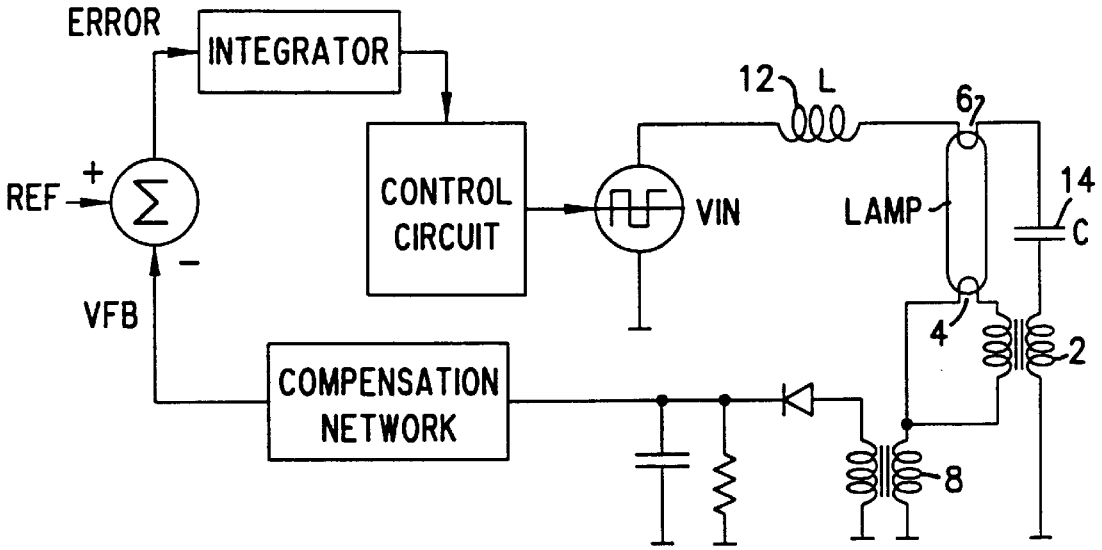
FIG. 1 (PRIOR ART)
FIG. 1 shows a prior art closed-loop circuit for controlling the brightness of a fluorescent lamp.

More specifically, in the circuit of the present invention, the voltage over the sense resistor 20 (VR1, FIG. 2) is compared against zero with a comparator 24 to detect the phase, or zero-crossing, of the lamp resonant current ($I_{L1}$). The comparator output is then AND-ed in AND gate 26 with the low-side half-bridge driver control signal (LIN) in order to reject other zero-crossings which may occur outside the time when MOSFET/IGBT 22 is 'on'. The resulting digital signal (FB) is now a representation of the lamp resonant circuit current as a "time" or a "phase" instead of a d.c. voltage as in the case with other existing solutions (FIG. 1).

Next, a reference "pulse" (REF) is generated by comparing a d.c. input control voltage (VIN) with an oscillating triangular wave voltage ($V_{OSC}$) through the use of a comparator 27 and an inverter 29. The reference pulse ($\overline{REF}$) is then AND-ed in AND gate 28 with the phase pulse (FB) to generate an error signal (ERROR). The summing junction necessary to close the loop in existing analog solutions (see FIG. 1) is realized in this phase detection solution with a simple "AND" gate.

The resulting error signal (ERROR) drives an electronic switch 30, which, when closed (i.e., when ERROR is "high"), injects a fixed current, for the duration of the error pulse, into a capacitor 32. The resulting voltage ($V_{VCO}$) is converted into a current with a linear regulation circuit (OPAMP 34, MOSFET 36, and resistor 38), and then "mirrored" with a current mirror (MOSFETS 40 and 42).

The resulting current is used to charge a capacitor 44 of an oscillator circuit. The resulting ramp, as it increases linearly from a lower threshold (th2) to a higher threshold (th1) (see FIG. 3), defines the on-time of the control signals LIN and HIN, and therefore the frequency of the oscillating half-bridge driver and the resulting output of the half-bridge (VS) as it drives the lamp resonant circuit.

If the error pulse (ERROR) goes "high", then the frequency is increased. The lamp power (or brightness) decreases until the phase of the lamp resonant circuit current (FB) equals the reference phase (REF). At this point the error pulse (ERROR) goes "low", and the switch 30 opens. Capacitor 32 is then discharged slightly through a fixed current source 46, therefore slightly decreasing the capacitor voltage ($V_{VCO}$). The frequency then decreases and the power in the lamp begins to increase. The phase decreases (FIG. 4) until the error pulse (ERROR) again goes "high" and the frequency increases. This process is continuous as the lamp is running and keeps the phase of the lamp resonant circuit current "locked" to the reference phase (REF).

Described in other words, during lamp running, the phase-locked loop of the present invention continues to output short pulses that "nudge" the integrator at the input of the VCO to keep the phase of the resonant current of the output stage exactly locked in phase with the reference. Since the phase of the resonant circuit current is directly related to lamp power, regulating the phase keeps the lamp brightness (Φ) regulated to the d.c. control input voltage (VIN).

The regulation process of the present invention is sufficiently fast such that smooth dimming of the lamp down to low brightness levels is possible.

Figure 7:
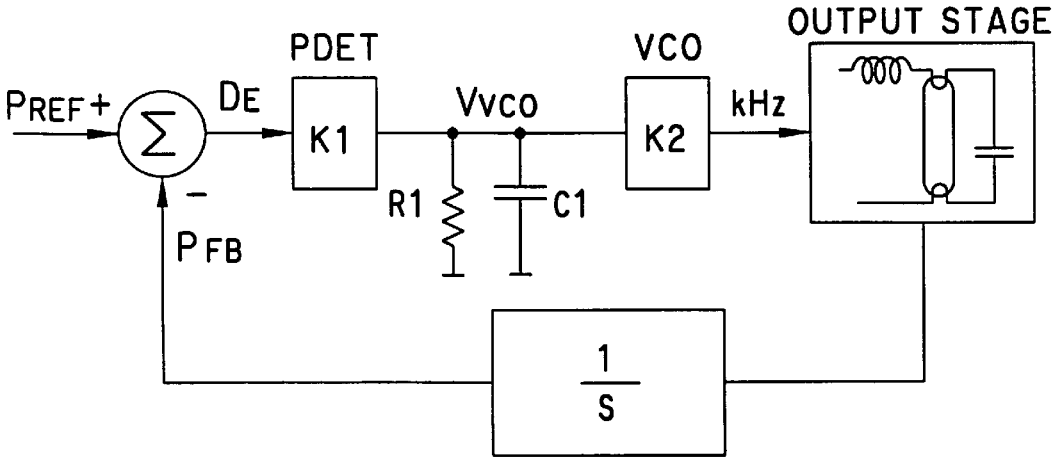
FIG. 7 shows the small-signal block diagram for the phase control circuit of the present invention.

Important considerations for analysis of the closed-loop system of the present invention is small-signal AC analysis for stability and large-signal transient response for performance. Using a phase-locked loop greatly simplifies the control scheme and results in a simple small-signal block diagram (FIG. 7). The loop consists of a summing junction or mixer responsible for generating an error pulse, $D_E$, indicative of the phase difference between some reference phase, $P_{REF}$, and phase being fed-back from the load current, $P_{FB}$. The error pulse $D_E$ is then converted to a voltage, $V_{VCO}$, with a gain given by K1. This voltage, $V_{VCO}$, is then converted to a frequency with a gain given by K2, with units of KHZ/V. The frequency is then converted to a phase through the resonant output stage.

Due to the AC nature of the load, it is easy to become confused with the phase corresponding to the lamp operating point and the small-signal phase at each operating point during dimming. For small-signal analysis, the output block which converts frequency to phase is simply a gain block which changes according to the operating point of the lamp. Furthermore, also present in the feedback block is an implicit integrator 1/S given by nature due to the fact that the phase is the integral of frequency.

Figure 8:
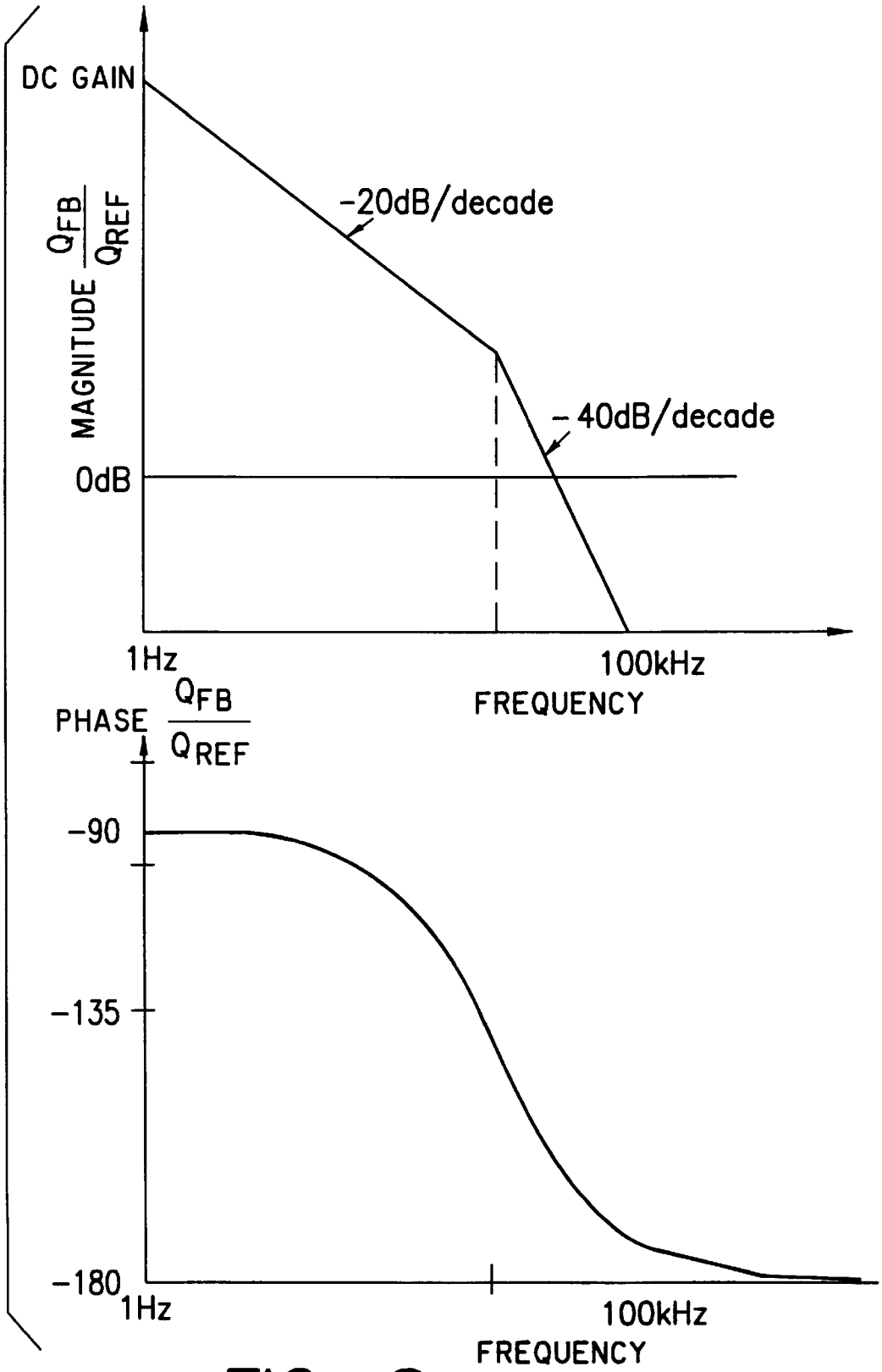
FIG. 8 shows the Bode diagram (magnitude and phase plots) for open-loop control-to-output response.

With the loop components defined, the system is seen to have two poles, one at a frequency defined by the capacitor C1 and resistor R1 at the input of the VCO, and the other given by the fact that phase is the integral of frequency. The Bode diagram for the system can then be drawn (FIG. 8). For best stability and phase margin, the pole formed by C1 and R1 should be moved as high in frequency as possible, allowing the gain to fall below OdB before the phase reaches −180°. It should also be noted that resistor R1 can also be substituted with a current source, as can current source I1 (FIG. 2) be substituted by a resistor.

The following are key points describing phase control and its application in connection with the present invention in powering a fluorescent lamp:

1) A phase-locked loop is able to track a signal automatically while coping with large amounts of noise.

2) A mathematical relationship exists between phase and lamp power when driving a lamp with a resonant RCL circuit, allowing the lamp power to be controlled by controlling the phase. More specifically, by controlling the phase angle of the inductor current with respect to the half-bridge voltage, the lamp power, and therefore lamp brightness can be controlled for closed-loop control or dimming.

3) The resulting circuit of the present invention for implementing phase control is much simpler than existing solutions. In particular, the loop is closed with a simple logic gate which gives an error pulse when the reference phase pulse overlaps in time with the feedback phase (i.e. an AND-gate).

4) For stability, the system is modeled as a 2-pole system, with one of the poles due to nature. Phase is the integral of frequency. The resulting system is easy to stabilize for different lamp types and various dimming levels.

5) For dimming, the system of the present invention requires no transformer to sense lamp current. Phase is detected by sensing the zero-crossing of the inductor current which, when sensed using a current-sensing resistor between the source of the lower half-bridge MOSFET (or other switching device) and ground, is a common sensing point for other features such as overcurrent, non-zero voltage switching and lamp presence detection as well, as described in co-pending U.S. application Ser. No. 09,022,554, filed concurrently herewith. The result is a greatly simplified, lower cost closed-loop/dimming solution.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of controlling the operating power of a fluorescent lamp, said lamp being driven by current from a lamp resonant circuit, the lamp resonant circuit being supplied with a time-varying input voltage having a chase, the method comprising the steps of:

detecting the phase of the lamp resonant circuit current; and maintaining a substantially constant phase relationship between the phase of the lamp resonant circuit and the phase of the input voltage, thereby regulating the lamp power.

2. A method as recited in claim 1, wherein the phase of the lamp resonant circuit current is detected by detecting the zero-crossings of the lamp resonant circuit current.

3. A method as recited in claim 2, further comprising the steps of:

using the zero-crossings of the lamp resonant circuit current are used to generate a phase pulse representing the lamp resonant circuit current as a function of time;

generating a reference pulse;

comparing the reference pulse with the phase pulse to generate an error signal indicative of the phase difference between the phase pulse and the reference pulse; and using the error signal to control the frequency of an oscillating half-bridge driver, such that the lamp brightness is increased or decreased as necessary to keep the phase of the lamp resonant circuit locked to the phase of the reference pulse.

4. A method as recited in claim 2, wherein the zero-crossings of the lamp resonant circuit current is detected by measuring the voltage across a resistor disposed in the path of said current, and comparing the voltage across the resistor to a zero voltage.

5. A method as recited in claim 3, wherein the phase pulse is generated by AND-ing the zero-crossing signal with a drive signal for the half-bridge driver.

6. A method as recited in claim 3, wherein the reference pulse signal is generated by comparing a d.c. input control voltage with an oscillating triangular wave voltage and inverting the output.

7. A method as recited in claim 3, wherein the frequency of the oscillating half-bridge driver is controlled by varying the on-time of signals controlling the half-bridge driver in accordance with the error signal.

8. A circuit for controlling the operating power of a fluorescent lamp, said lamp being driven by current from a resonant circuit, the lamp resonant circuit being supplied with a time-varying input voltage having a phase, said circuit comprising:

means for detecting the phase of the lamp resonant circuit current; and means for maintaining a substantially constant phase relationship between the phase of the lamp resonant circuit current and the phase of the input voltage, thereby regulating the lamp power.

9. A circuit as recited in claim 8, wherein the means for detecting the phase of the lamp resonant circuit comprises a resistor disposed in the path of said current, and a comparator for comparing the voltage across the resistor to a zero voltage to determine the zero-crossings of the lamp resonant circuit current.

10. A circuit as recited in claim 9, further comprising:

means for using the zero-crossings to generate a phase pulse representing the lamp resonant circuit current as a function of time;

means for generating a reference pulse;

means for comparing the reference pulse with the phase pulse to generate an error signal indicative of the phase difference between the phase pulse and the reference pulse; and means for controlling the frequency of an oscillating half-bridge driver in accordance with the error signal, such that the lamp brightness is increased or decreased as necessary to keep the phase of the lamp resonant circuit locked to the phase of the reference pulse.

11. A circuit as recited in claim 10, wherein the means for generating a phase pulse comprises an AND gate for AND-ing the zero-crossing signal with a drive signal for the half-bridge driver.

12. A circuit as recited in claim 10, wherein the means for generating a reference pulse signal comprises a comparator for comparing a d.c. input control voltage with an oscillating triangular wave voltage and an inverter for inverting the output.

13. A circuit as recited in claim 10, wherein the means for controlling the frequency of the oscillating half-bridge driver comprises an oscillator circuit including a capacitor which stores a voltage which is ramped up in accordance with the error signal and determines the frequency of the oscillating half-bridge driver.

* * * * *